US006146094A

United States Patent [19]

Obana et al.

[11] Patent Number: 6,146,094

[45] Date of Patent: Nov. 14, 2000

[54] MOTOR-DRIVEN BLOWER AND METHOD OF MANUFACTURING IMPELLER FOR MOTOR-DRIVEN BLOWER

[75] Inventors: Takeshi Obana; Kiyomi Nakamura; Masahisa Inagaki; Yasuhisa Aono, all of Hitachi; Hisanori Okamura, Tokai-mura; Hisao Suka, Hitachi; Fumio Jyoraku, Hitachiohta, all of Japan

[73] Assignee: Hitachi, Ltd., Tokyo, Japan

[21] Appl. No.: 09/114,485

[22] Filed: Jul. 13, 1998

[30] Foreign Application Priority Data

Jul. 11, 1997 [JP] Japan ..... 9-186230

[51] Int. Cl.[7] ..... F04D 29/30

[52] U.S. Cl. ..... 415/200; 415/208.2; 415/186 R; 415/234; 415/241 R; 415/211.2

[58] Field of Search ..... 415/211.2, 208.2, 415/200; 416/186 R, 213 R, 234, 241 R

[56] References Cited

U.S. PATENT DOCUMENTS

| | | | |
|---|---|---|---|
| 3,782,851 | 1/1974 | Hackbarth et al. | 415/213 |
| 3,993,476 | 11/1976 | Koike | 75/141 |
| 4,322,200 | 3/1982 | Stiegelmeier | 416/184 |
| 5,328,332 | 7/1994 | Chiang | 416/186 R |
| 5,336,050 | 8/1994 | Guida et al. | 416/186 R |
| 5,558,499 | 9/1996 | Kobayashi | 416/186 R |
| 5,573,374 | 11/1996 | Giberson | 416/186 R |

OTHER PUBLICATIONS

Brady, George S., Materials Handbok, 13th edition, McGraw–Hill, Inc., New York, pp. 116–117, 501–503, Dec. 31, 1991.

*Primary Examiner*—Edward K. Look
*Assistant Examiner*—Liam McDowell
*Attorney, Agent, or Firm*—Antonelli, Terry, Stout & Kraus, LLP

[57] ABSTRACT

Reduction of air resistance which acts on the conventional motor-driven blower is limited because crushed protrusions are formed on the surface of the plate of the impeller of the conventional motor-driven blower, and this air resistance is a significant impediment to an increase of the operating speed of the motor-driven blower. Thus, an impeller is provided which comprises a front plate having a suction opening, a back plate disposed opposite to the front plate, and a plurality of blades disposed between the front plate and the back plate. At least either the front plate or the back plate is formed integrally with the blades.

7 Claims, 11 Drawing Sheets

MOTOR-DRIVEN BLOWER AND METHOD OF MANUFACTURING IMPELLER FOR MOTOR-DRIVEN BLOWER

BACKGROUND OF THE INVENTION

The present invention relates to a motor-driven blower for a vacuum cleaner, and a method of manufacturing an impeller for such a motor-driven blower.

An impeller included in a conventional motor-driven blower comprises a front plate provided in its central part with a suction opening, a back plate disposed opposite to the front plate, and blades disposed between the front and the back plate. Each of the blades is provided with projections to be deformed for securing the blades, the projections being inserted in slots formed in the front and the back plate, and the parts of the projections projecting from the front plate and the back plate are crushed to fix the blades to the front plate and the back plate. All of those components of the impeller are formed of an Al alloy. The impeller thus assembled is fastened to the rotatable shaft of a motor with a screw, and a fan casing is disposed over the impeller to form the motor-driven blower.

A motor-driven blower intended for use in a recent vacuum cleaner was designed so as to operate at an increased operating speed to produce an increased suction with an improved efficiency.

Since the impeller of the conventional motor-driven blower is constructed by crushing the parts of the projections projecting from the front plate and the back plate, as mentioned above, the crushed parts of the projections protrude from the outer surfaces of the front plate and the back plate. The resistance of air against the movement of the crushed parts of the impeller is significant when the impeller rotates at a high rotating speed and is an impediment to the possible increase of the operating speed of the motor-driven blower.

A technique proposed in, for example, JP-A No. 1-310198 to solve such a problem rounds the corners of end parts of the projections to be crushed to reduce the air resistance against the movement of the crushed parts of the projections.

Although the technique proposed in JP-A No. 1-310198 rounds the corners of end parts of the projections to be crushed to reduce air resistance against the movement of the crushed parts of the projections, the crushed parts still remain on the outer surfaces of the front plate and the back plate. Therefore, there is a limit to the reduction of the air resistance that can be achieved in this way and so the crushed parts remain as a significant impediment to an increase of the operating speed of the motor-driven blower.

An increase in the operating speed of the motor-driven blower entails an increase in stress induced in the impeller. Therefore, the rigidity of the impeller must be enhanced. Since the components of the conventional impeller are fastened together by crushing protruding parts of the blades and the strength of the joints of the components formed in this way is lower than the strength of the blades and the plates, the rigidity of the impeller constructed by assembling the components in this manner provided by the prior art is not very high, and hence increase in the rotating speed of the impeller is limited.

An increase in the operating speed of the motor-driven blower entails an increase in the load on the rotating shaft of the electric motor. Therefore, it is necessary to reduce the load on the rotating shaft of the electric motor by reducing the weight of the impeller, which is typically formed of an Al alloy.

SUMMARY OF THE INVENTION

Accordingly, it is an object of the present invention to solve the foregoing problems by providing a motor-driven blower having an impeller which exhibits a reduced air resistance during the rotation thereof, which has an enhanced rigidity, and which is capable of reducing the load on the rotating shaft of the electric motor driving the impeller for rotation, as well as an impeller which is capable of operating at an increased speed, and to provide a method of manufacturing an impeller for such a motor-driven blower.

With the foregoing object in view, according to a first aspect of the present invention, a motor-driven blower comprises an electric motor enclosed in a housing, an impeller fixedly mounted on a rotating shaft included in the electric motor, stationary guide blades disposed downstream of the impeller, and a fan casing covering the impeller and the stationary guide blades; wherein the impeller comprises a front plate having a suction opening, a back plate disposed opposite to the front plate, and a plurality of blades disposed between the front plate and the back plate, with at least either the front plate or the back plate being formed integrally with the blades.

According to a second aspect of the present invention, an impeller comprises a front plate, a back plate disposed opposite to the front plate, and a plurality of blades disposed between the front plate and the back plate; wherein at least either the front plate or the back plate is formed integrally with the blades, a brazing metal layer is formed on a surface of the other plate not formed integrally with the blades, and the other plate is brazed to the blades by way of the brazing metal layer.

According to the present invention, the impeller is formed as a monolithic structure and does not have any crushed projections. Therefore, the impeller of the present invention is not subject to air resistance that may be produced if the impeller has crushed projections and does not generate any noise which may be generated if the impeller has crushed projections. A motor-driven blower provided with the impeller of the present invention is able to operate at an increased operating speed and to improve the efficiency of suction of a vacuum cleaner.

BRIEF DESCRIPTION OF THE INVENTION

These and other objects of the invention will be seen by reference to the description, taken in connection with the accompanying drawing, in which.

DETAILED DESCRIPTION OF THE PREFERRED EMBODIMENTS

Preferred embodiments of the present invention will be described with reference to the accompanying drawings.

Figure 6:
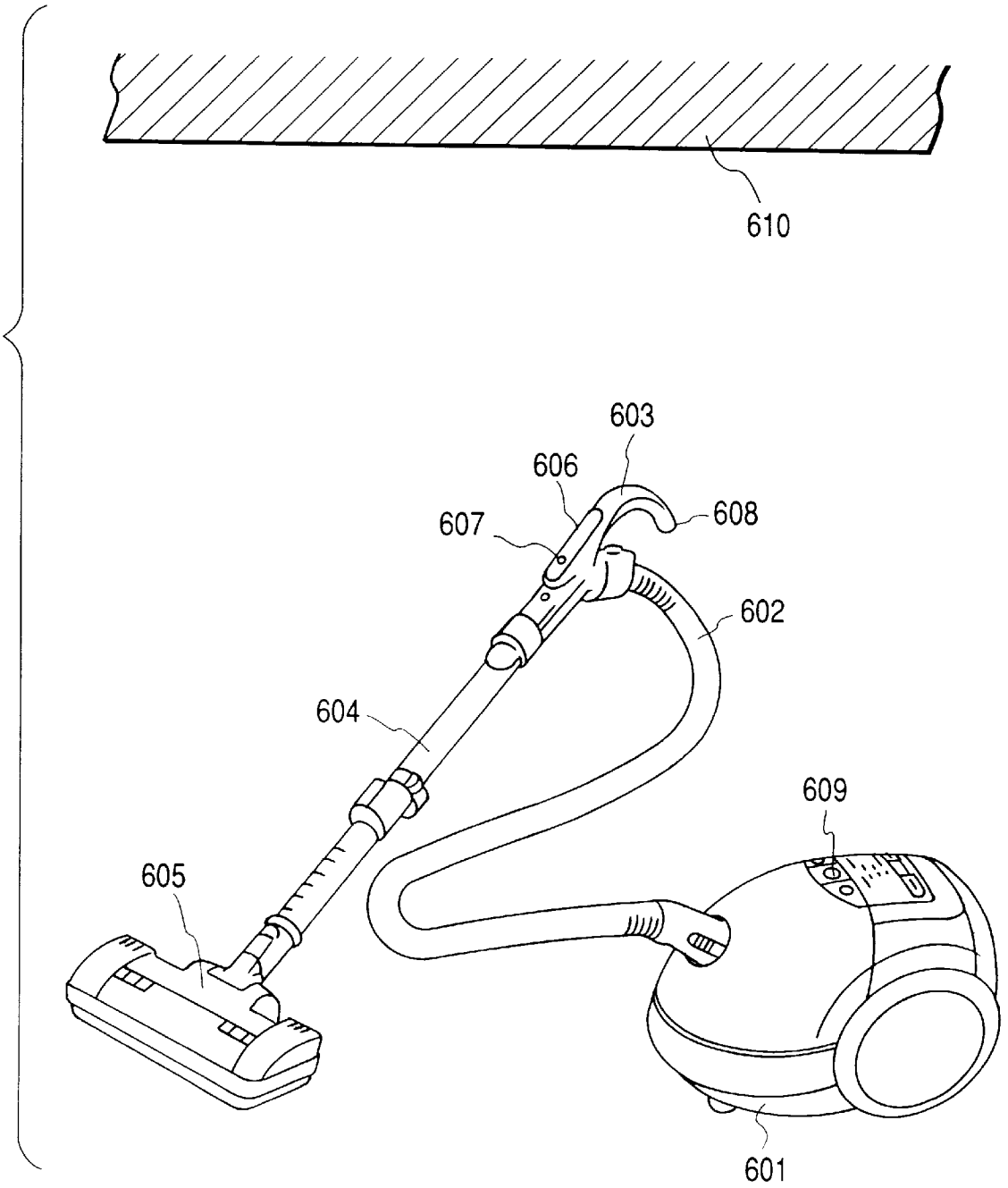
FIG. 6 is a perspective view of a vacuum cleaner according to the present invention.

FIG. 6 is a perspective view of a vacuum cleaner relating to a preferred embodiment of the present invention.

Referring to FIG. 6, there are shown a cleaner unit 601 internally provided with built-in devices including a motor-driven blower, a hose 602 having one end connected to a suction opening formed in the cleaner unit 601, a hose handle 603, an extension wand 604 connected to the other end of the hose 602 (the hose handle 603), a suction head 605 connected to the extension wand 604, a switch operating unit 606 attached to the hose handle 603, a first infrared emitting unit 607 attached to the hose handle 603, a second infrared light emitting unit 608 attached to the hose handle 603, an infrared light receiving unit 609 attached to an upper wall of the cleaner unit 601, and a ceiling 610.

The operation of the vacuum cleaner relating to the preferred embodiment will be described with reference to FIG. 6.

An operator pushes one of the switch buttons arranged in the switch operating unit 606. Then, infrared signals representing codes corresponding to the operated switch button are transmitted by the first infrared light emitting unit 607 and the second infrared light emitting unit 608. The first infrared light emitting unit 607 is directed vertically upward in the normal state of use. Therefore, the infrared signal emitted by the first infrared light emitting unit 607 will be directed against the ceiling or an wall of the room, reflected therefrom and fall on the infrared light receiving unit 609. The second infrared light emitting unit 608 is directed obliquely downward at an angle to a horizontal plane. Therefore, the infrared signal emitted by the second infrared light emitting unit 608 falls directly on the infrared light receiving unit 609. The infrared signals are received by infrared photoelectric devices, not shown, arranged on the cleaner unit 601, and a control circuit, not shown, controls the operation of the cleaner unit 601 according to the infrared signals.

Figure 7:
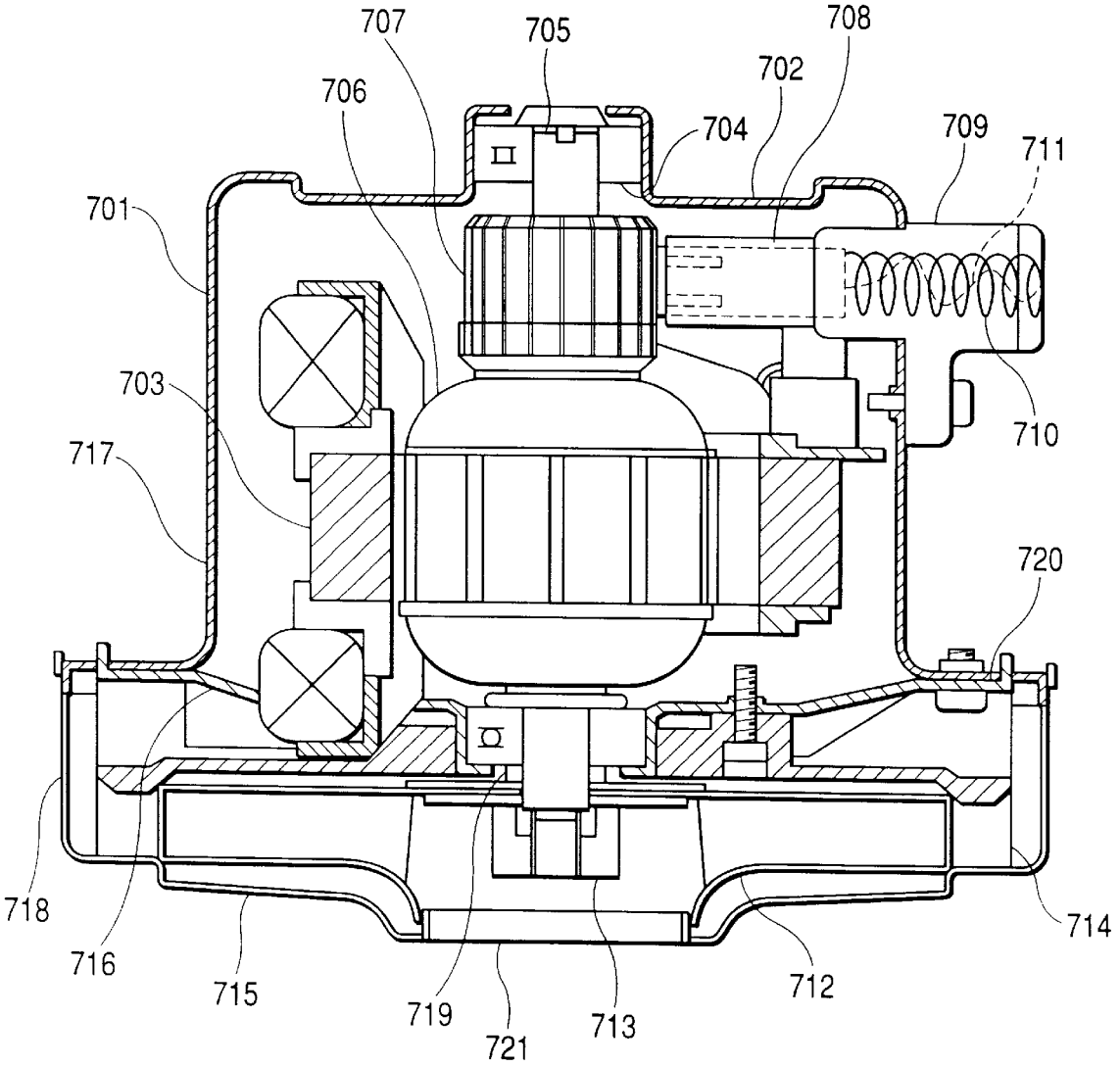
FIG. 7 is a longitudinal sectional view of a motor-driven blower according to the present invention.

The construction of the motor-drive blower disposed inside the cleaner unit 601 will be described with reference to FIG. 7.

A motor-driven blower 701 comprises an electric motor unit 717 and a blower unit 718. The electric motor unit 717 comprises a housing 702, a stator 703 fixed to the housing 702, a rotor shaft 705 supported in bearings 704 and 719 held on the housing 702, a rotor 706 fixedly mounted on the rotator shaft 705, a commutator 707 fixedly mounted on the rotor shaft 705, a brush 708 electrically coupled to the commutator 707, and a brush holder 709 attached to the housing 702 for holding the brush 708.

The commutator 707 is provided along its circumference with commutator bars connected to coils wound on the rotor 706.

The brush 708 is held in the brush holder 709 and is pressed against the commutator 707 so as to be in sliding contact with the commutator 707 under a force produced by a spring 710. A lead wire 711 electrically connected to the brush connects the brush 708 electrically to an external electrode. The lead wire 711 is connected to a terminal, not shown, attached to the brush holder 709. An end bracket 720 is attached to the housing 702 to connect a blower unit 718 to the electric motor unit 717.

The end bracket 720 is provided with an air inlet opening 716 through which air blown by the blower unit 718 flows toward the electric motor 717. The end bracket 720 is provided with stationary guide blades 714. An impeller 712 disposed on the upstream side of the stationary guide blades 714 is fastened to the rotor shaft 705 with a nut 713. A casing 715 is mounted forcibly on and fixed to the end bracket 720 and is provided in its central part with a suction opening 721.

When the electric motor is actuated, the rotor 706 rotates, and the impeller 712, which is coaxial with the rotor 706, is rotated to suck air through the suction opening 721 of the fan casing 715. Air flows through the impeller 712 and the stationary guide blades 714 and is discharged through the air inlet opening 716 toward the electric motor 717.

The construction of the impeller 712 will be described hereinafter with reference to FIGS. 8 and 9.

Figure 8:
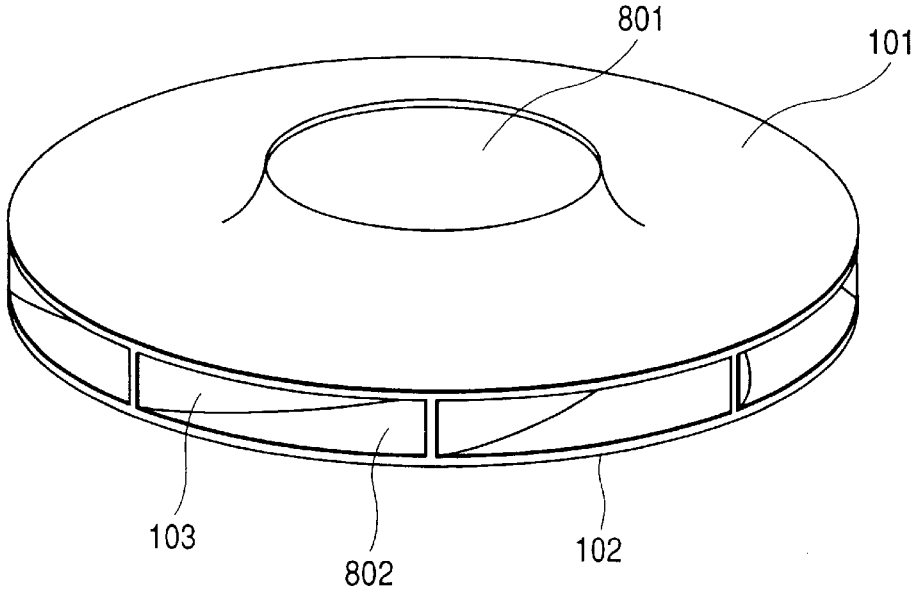
FIG. 8 is a perspective view of an impeller according to the present invention.
Figure 9:
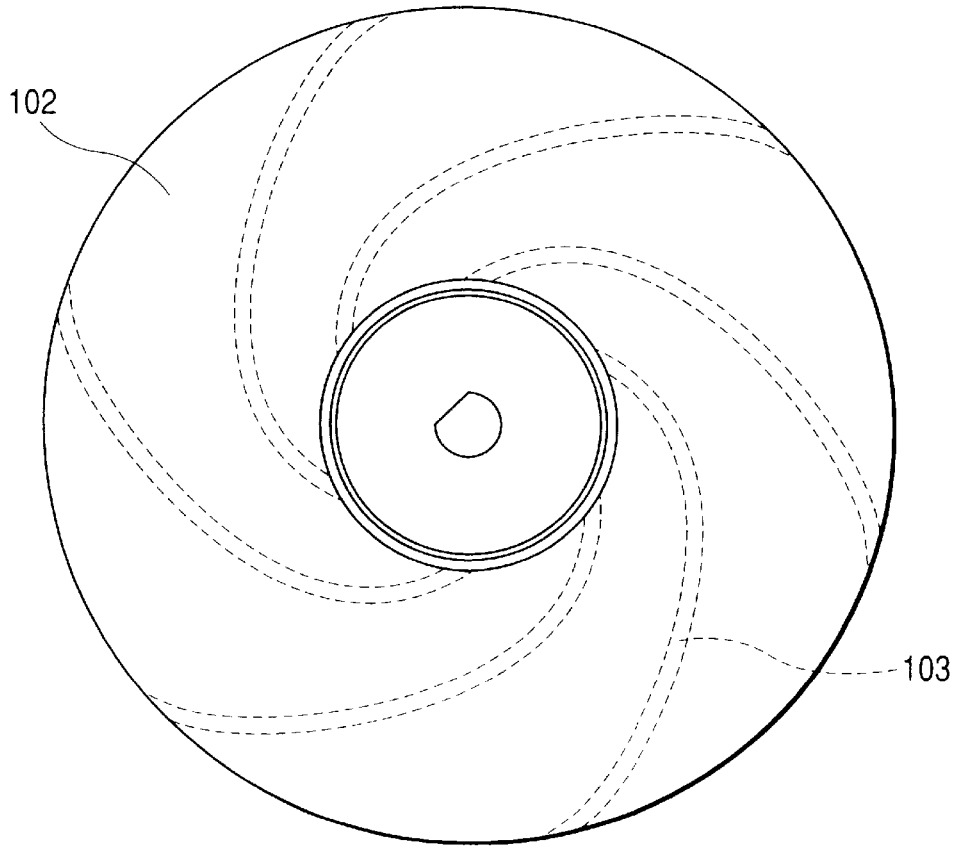
FIG. 9 is a plan view of an impeller according to the present invention.

FIGS. 8 and 9 are a perspective view and a plan view, respectively, of the impeller 712 relating to the embodiment of the present invention.

Referring to FIGS. 8 and 9, the impeller 712 comprises a front plate 101 provided with a suction opening 801, a back plate 102 disposed below and opposite to the front plate 101, and blades 103 sandwiched between the front plate 101 and the back plate 102. The blades 103 are curved as shown in FIG. 9. The front plate 101, the back plate 102 and the blades 103 define a plurality of air outlets 802. When the impeller 712 is rotated, air is sucked through the suction opening 801 into the impeller, is discharged through the air outlets 802 toward the electric motor to cool the electric motor, and is discharged through the discharge opening of the cleaner unit.

The impeller 712 needs to be rotated at a high rotating speed to produce a high suction. The impeller 712 must be lightweight and the air resistance that will act on the impeller 712 must be reduced to rotate the impeller 712 at a high rotating speed. A structure effective in forming the impeller 712 so as to have a lightweight construction and a reduced air resistance acting on the impeller 712 will be described with reference to FIGS. 1 to 4.

Figure 1:
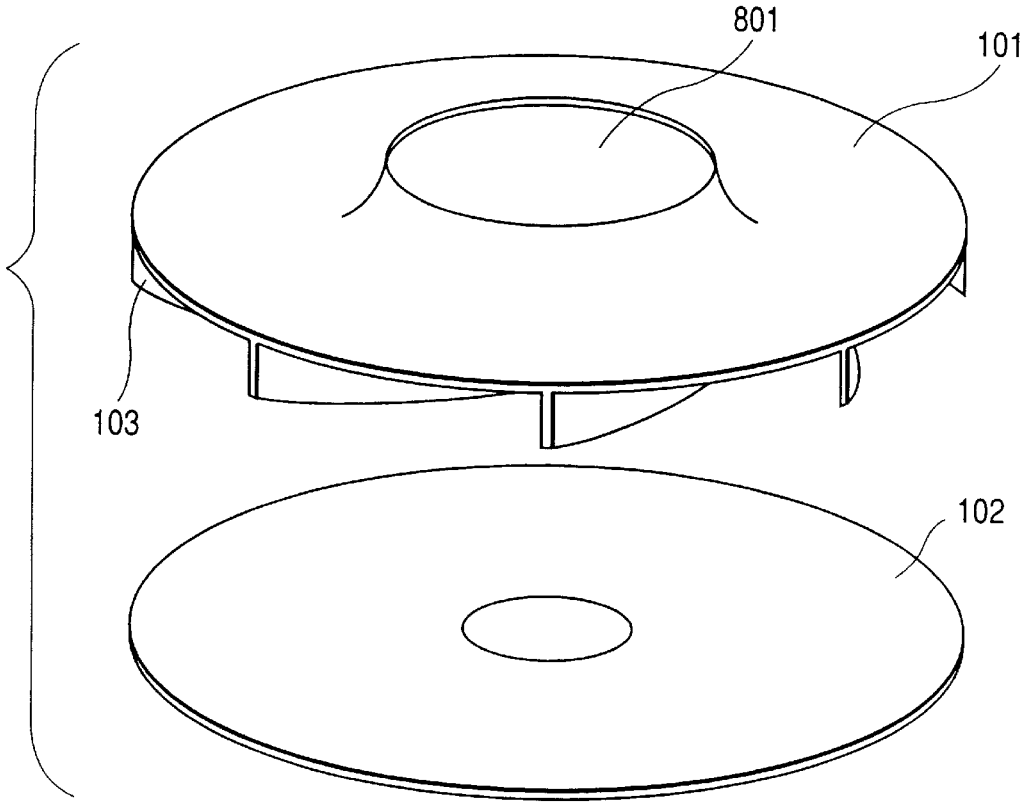
FIG. 1 is an exploded perspective view of an impeller according to the present invention.

FIG. 1 is an exploded perspective view of the impeller 712 relating to the embodiment of the present invention.

As shown in FIG. 1, the front plate 101 and the blades 103 are formed in a monolithic structure.

The front plate 101 and the blades 103 are formed in a monolithic structure by an injection molding process. This injection molding process, similar to an injection molding process for molding a resin, kneads and melts pellets of a light metal in an injection molding machine without using a melting furnace, and injects the molten light metal into a mold to form a molding.

The front plate 101 and the blades 103 can be formed as a monolithic structure, as shown in FIG. 1, by the injection molding process. In this embodiment, no crushed protrusions formed are provided on the outer surface of the front plate 101 because the blades 103 are formed integrally with the front plate 101 by molding. Therefore, only reduced air resistance acts on the outer surface of the front plate 101.

In this embodiment, the monolithic structure formed by the front plate 101 and the blades 103 is made of a Mg alloy of Grade AZ91D specified in the ASTM (American Society of Testing Materials) Standards, USA. The Mg alloy AZ91D contains 8.3 to 9.7% by weight Al, 0.35 to 1.0% by weight Zn and 0.15 to 0.50% by weight Mn, having high moldability, and is a high-purity alloy with reduced amounts of Cu, Ni and Fe.

In this embodiment, the monolithic structure of the front plate 101 and the blades 103 may be formed of a Mg alloy of Grade AM60B specified in the ASTM Standards, USA, containing 5.5 to 6.5% by weight Al, 0.22% by weight Zn and 0.24 to 0.6% by weight Mn, instead of an Al alloy of Grade AZ91D.

The Mg alloy has a specific gravity of about 1.8 g/cm$^3$, which is about ⅔ of the specific gravity of 2.7 g/cm$^3$ of an Al alloy.

A method of bonding the back plate 102 to the blades 103 formed integrally with the front plate 101 will be described with reference to FIG. 2.

The back plate 102 is formed of an Al-Mg alloy of Grade A5052 specified in the JIS (Japanese Industrial Standards), i.e., an Al alloy. The inner surface of the back plate 102 is coated with a brazing metal layer 201. In this embodiment, the brazing metal forming the brazing metal layer 201 is Zn.

This embodiment employs an electroplating process to form the brazing metal layer 201 on the inner surface of the back plate 102. The electroplating process comprises degreasing, rinsing, electroplating, rinsing and drying. The desired brazing metal layer 201 of Zn is formed on the back plate 102 by using an appropriate electrolytic solution of an appropriate temperature, and supplying a current of an appropriate current density for an appropriate plating time.

The front plate 101, integrally provided with the blades 103, and the back plate 102 are held contiguously and coaxially without applying any pressure thereto, or with the application of a pressure that will not deform the front plate 101, the back plate 102 and the blades 103, and the front plate 101, the back plate 102 and the blades 103 are heated at an appropriate temperature below the melting points of the front plate 101, the back plate 102 and the blades 103 for an appropriate time to bond the back plate 102 to the blades 103 by brazing.

When heated at the appropriate temperature for the appropriate time, the brazing metal layer 201 melts and penetrates the back plate 102 and the blades 103 to form reaction parts 202, which bond the back plate 102 firmly to the blades 103.

In this embodiment, no crushed protrusions formed by are provided on the outer surface of the back plate 102 because the back plate 102 is bonded to the blades 103 by brazing. Therefore, only a reduced air resistance acts on the outer surface of the back plate 102.

Although this embodiment uses an electroplating process to form the brazing metal layer 201 on the back plate 102, the brazing metal layer 201 may be formed by a physical vapor deposition process, a chemical vapor deposition process, an ion plating process, a spraying process or a combination of those processes.

Although this embodiment uses a brazing metal layer of Zn, a metal having a low melting point, such as Sn or Pb, and an alloy of a low melting point containing such a metal as a principal component, are possible brazing materials.

Preferable alloys having a low melting point are Zn—Sn alloys, Zn—Pb alloys, Sn—Pb alloys, Zn—Mg alloys and Zn—Al alloys.

Although this embodiment uses Al alloy of Grade A5052, JIS for forming the back plate 102, Al—Mn alloys (System 3000, JIS), Al—Si alloys (System 4000, JIS), Al—Cu—Mg alloys (System 2000, JIS), Al—Mg—Si alloys (System 6000, JIS) and Al—Zn—Mg alloys (System 7000, JIS) are possible materials for forming the back plate 102.

In this embodiment, the front plate 101 and the blades 103 of the impeller 712 are made of Mg alloy, the back plate 102 of the impeller 712 is made of Al alloy having a specific gravity greater than that of the Mg alloy, and the impeller 712 is mounted on the rotor shaft of the electric motor with the back plate 102 on the side facing the electric motor. Therefore, the whirling of the rotor shaft due to an unbalanced distribution of the load thereon can be suppressed, noise can be reduced, the abrasion of the carbon brush can be reduced and the life of the motor-driven blower can be extended.

Although this embodiment employs a back plate 102 of Al alloy, the back plate 102 may be made of the same Mg alloy as that forming the front plate 101 and the blades 103.

A second embodiment of the present invention will be described with reference to FIG. 2.

Figure 2:
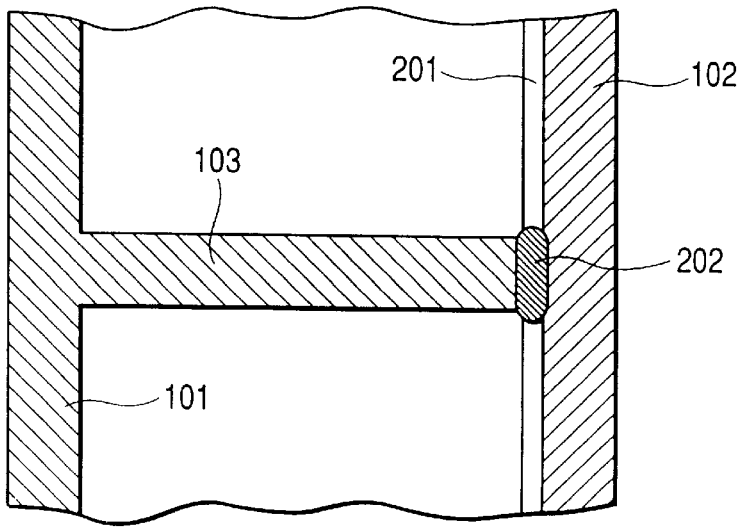
FIG. 2 is an enlarged, fragmentary sectional view of an impeller representing a preferred embodiment according to the present invention.

FIG. 2 is an enlarged, fragmentary sectional view of an impeller 712 relating to the second embodiment of the present invention.

The impeller 712, similar to the impeller 712 relating to the first embodiment, has a front plate 101 and blades 103 formed of a Mg alloy in a monolithic structure.

The Mg alloy employed in this embodiment is a Mg alloy of Grade AZ91D or AM60B specified in the ASTM Standards, USA. The front plate 101 and the blades 103 are formed as a monolithic structure by an injection molding process.

A back plate 102 to be disposed opposite to the monolithic structure of the front plate 101 and the blades 103 is made, similar to the monolithic structure, of the Mg alloy of Grade AZ91D, ASTM Standards. A brazing metal layer 201 of Zn is formed beforehand on the inner surface of the back plate 102.

In this embodiment, the brazing metal layer 201 is formed on the back plate 102 by cladding the back plate 102 with the brazing metal layer 201 of the Mg alloy of Grade AZ91D by a hot rolling pressure bonding process.

The hot rolling pressure bonding process heats the back plate 102 and a metal sheet (a Zn sheet) for forming the brazing metal layer 201 respectively at appropriate temperatures respectively lower than the melting points of the back plate 102 and the metal sheet, superposes the back plate 102 and the metal sheet, compresses the superposed back plate 102 and the metal sheet between a pair of rolling rollers to form the brazing metal layer 201 of a desired thickness on the back plate 102. The brazing metal layer 201 may be formed on the back plate 102 by another method which passes the superposed back plate 102 and the metal sheet between a pair of rolling rollers, supplies a current across the pair of rolling rollers to compress the back plate 102 and the metal sheet for forming the brazing metal layer 201 between the pair of rolling rollers and to heat the back plate 102 and the metal sheet at temperatures respectively lower than the melting points of the back plate 102 and the metal sheet. When this method is employed, the back plate 102 and the metal sheet need not be heated before subjecting the same to rolling between the pair of rolling rollers and heating by the current supplied across the pair of rolling rollers.

The front plate 101, integrally provided with the blades 103, and the back plate 102 provided with the brazing metal layer 201 are held contiguously and coaxially without applying any pressure thereto, or with the application of a pressure that will not deform the front plate 101, the back plate 102 and the blades 103, and the front plate 101, the back plate 102 and the blades 103 are heated at an appropriate temperature below the melting points of the front plate 101, the back plate 102 and the blades 103 for an appropriate time to bond the back plate 102 to the blades 103 with the brazing metal layer 201 by brazing.

When heated at the appropriate temperature for an appropriate time, the brazing metal layer 201 melts and penetrates the back plate 102 and the blades 103 to form reaction parts 202, which bond the back plate 102 firmly to the blades 103.

In this embodiment, no crushed protrusions are provided on the outer surface of the back plate 102 because the back plate 102 is bonded to the blades 103 by brazing. Therefore, only a reduced air resistance acts on the outer surface of the back plate 102.

Although this embodiment uses a brazing metal layer of Zn, a metal having a low melting point, such as Sn or Pb, and an alloy of a low melting point containing such a metal as a principal component are possible brazing materials. Preferable alloys having a low melting point are Zn—Sn alloys, Zn—Pb alloys, Sn—Pb alloys, Zn—Mg alloys and Zn—Al alloys.

Although this embodiment uses Mg alloy of Grade AZ91D, for forming the back plate 102, a Mg alloy of Grade AM31B, ASTM Standards, USA and containing about 2.8% by weight Al, about 0.87% by weight Zn and about 0.41% by weight Mn or a Mg Alloy of Grade AM60B, ASTM Standards may be used for forming the back plate 102.

A third embodiment of the present invention will be described with reference to FIG. 3.

Figure 3:
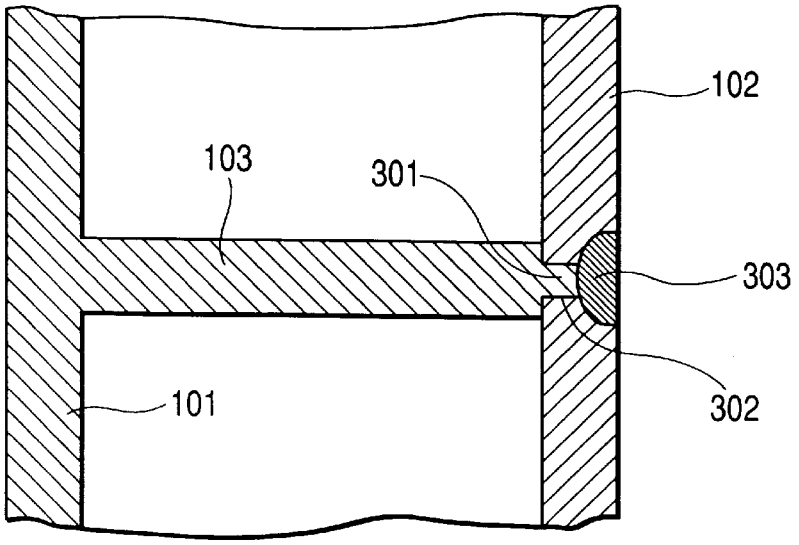
FIG. 3 is an enlarged, fragmentary sectional view of an impeller representing a preferred embodiment according to the present invention.

FIG. 3 is an enlarged, fragmentary sectional view of an impeller 712 relating to the third embodiment of the present invention.

The impeller 712, similar to the impellers 712 relating to the foregoing embodiments, has a front plate 101 and blades 103 formed of a Mg alloy in a monolithic structure.

The Mg alloy employed in this embodiment is a Mg alloy of Grade AZ91D or AM60B specified in the ASTM Standards, USA. The front plate 101 and the blades 103 are formed in a monolithic structure by an injection molding process.

The blades 103 are provided with a plurality of fixing projections 301. A back plate 102 is formed of an Al—Mg alloy of Grade A5052, JIS. The back plate 102 is provided with a plurality of holes 302 to receive the fixing projections 301 at positions respectively corresponding to the projections 301 of the blades 103. Preferably, the height of the fixing projections 301 is equal to the thickness of the back plate 102.

A method of fastening the back plate 102 to the monolithic structure of the front plate 101 and the blades 103 will be described hereinafter.

The fixing projections 301 of the blades 103 formed integrally with the front plate 101 are inserted into the holes 302 of the back plate 102, reaction parts 303 are formed by subjecting the projections 301 inserted into the holes 302 to spot welding, i.e., an electric resistance welding, meeting desired conditions for the welding current, welding time, quality of electrode, diameter of electrode, and the like, to connect the back plate 102 firmly to the monolithic structure of the front plate 101 and the blades 103. Parts of the fixing projections and parts of the back plate 103 around the holes 302 melt during welding.

A laser welding process, an electron beam welding process or a combination of a laser welding process and an electron beam welding process may be used instead of the spot welding process to connect the back plate 102 to the monolithic structure of the front plate 101 and the blades 103.

Although this embodiment uses Al alloy of Grade A5052, JIS for forming the back plate 102, Al—Mn alloys (System 3000, JIS), Al-Si alloys (System 4000, JIS), Al—Cu—Mg alloys (System 2000, JIS), Al—Mg—Si alloys (System 6000, JIS) and Al—Zn—Mg alloys (System 7000, JIS) are possible materials for forming the back plate 102.

In this embodiment, the blades 103 and the back plate 102 are welded together, and no crushed protrusions for fastening the back plate 102 to the blades 103 are provided on the outer surface of the back plate 102. Thus, only a reduced air resistance acts on both outer surfaces of the front plate 101 and the back plate 102.

A fourth embodiment of the present invention will be described with reference to FIG. 4.

Figure 4:
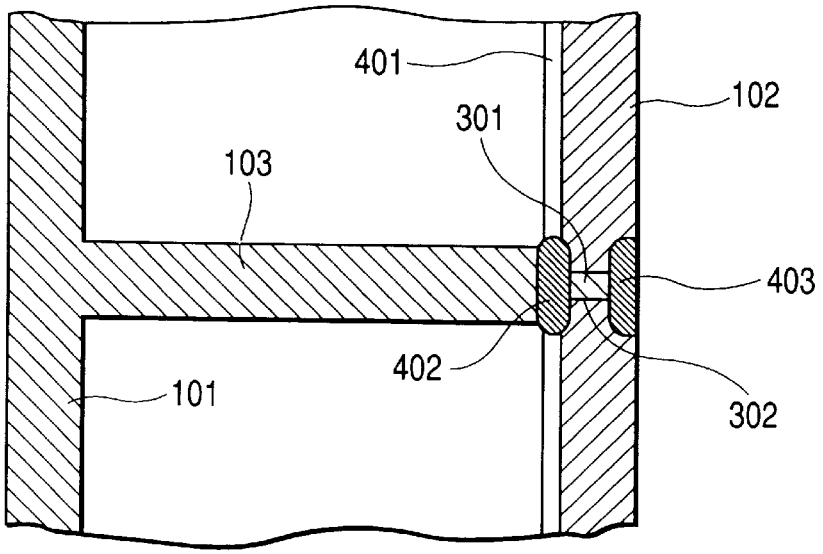
FIG. 4 is an enlarged, fragmentary sectional view of an impeller representing a preferred embodiment according to the present invention.

FIG. 4 is an enlarged, fragmentary sectional view of an impeller 712 relating to the fourth embodiment of the present invention.

The impeller 712, similar to the impellers 712 relating to the foregoing embodiments, has a front plate 101 and blades 103 formed of a Mg alloy as a monolithic structure.

The Mg alloy employed in this embodiment is a Mg alloy of Grade AZ91D or AM60B specified in the ASTM Standards, USA. The front plate 101 and the blades 103 are formed as a monolithic structure by an injection molding process.

The blades 103 are provided with a plurality of fixing projections 301. Aback plate 102 is formed of an Al—Mg alloy of Grade A5052, JIS. The back plate 102 is provided with a plurality of holes 302 to receive the fixing projections 301 at positions respectively corresponding to the projections 301 of the blades 103. A brazing metal layer 401 of Zn is formed on an inner surface of the back plate 102.

This embodiment employs an electroplating process to form the brazing metal layer 401 on the inner surface of the back plate 102. The electroplating process comprises degreasing, rinsing, electroplating, rinsing and drying. The desired brazing metal layer 401 of Zn is formed on the back plate 102 by using an appropriate electrolytic solution of an appropriate temperature, and supplying a current of an appropriate current density for an appropriate plating time.

A method of fastening the back plate 102 to the monolithic structure of the front plate 101 and the blades 103 will be described hereinafter.

The fixing projections 301 of the blades 103 formed integrally with the front plate 101 are inserted into the holes 302 of the back plate 102 from the side of the brazing metal layer 401. The monolithic structure and the back plate 102 are heated at a desired temperature lower than the melting points thereof for a desired heating time to bond the monolithic structure and the back plate 102 together by brazing using the brazing metal layer 401. The brazing metal layer 401 penetrates the monolithic structure and the back plate 102 to form reaction parts 402 when heated at the desired temperature for the desired time.

Parts of the back plate 102 around the holes 302 into which the fixing projections 301 are inserted are melted by hot pressing at a desired temperature, pressure and heating time to form reaction parts 403 for bonding together the monolithic structure and the back plate 102. Parts of the back plate 102 around the holes 302 and parts of the fixing projections 301 melt when heated and when a pressure is applied thereto.

Although this embodiment bonds together the monolithic structure 804 and the back plate 102 by brazing and by subsequent hot pressing, the hot pressing operation may be executed before brazing.

Although this embodiment uses an electroplating process to form the brazing metal layer 401 on the back plate 102, the brazing metal layer 401 may be formed by a physical vapor deposition process, a chemical vapor deposition process, an ion plating process, a spraying process or a combination of some of those processes.

Although this embodiment uses a brazing metal layer of Zn, a metal having a low melting point, such as Sn or Pb, and an alloy of a low melting point containing such a metal as a principal component are possible brazing materials. Preferable alloys having a low melting point are Zn—Sn alloys, Zn—Pb alloys, Sn—Pb alloys, Zn—Mg alloys and Zn—Al alloys.

Although this embodiment employs hot pressing to bond together the monolithic structure of the front plate 101 and the blades 103, and the back plate 103, a laser welding process, electron beam welding process, an electric resistance welding or a combination of those processes may be used.

Although this embodiment uses Al alloy of Grade A5052, JIS for forming the back plate 102, Al—Mn alloys (System 3000, JIS), Al—Si alloys (System 4000, JIS), Al—Cu—Mg alloys (System 2000, JIS), Al—Mg—Si alloys (System 6000, JIS) and Al—Zn—Mg alloys (System 7000, JIS) are possible materials for forming the back plate 102.

Since this embodiment bonds together the blades 103 and the back plate 102 by welding, no crushed protrusions for fastening the back plate 102 to the blades 103 are provided on the outer surface of the back plate 102. Thus, only a reduced air resistance acts on both the outer surfaces of the front plate 101 and the back plate 102.

Figure 5:
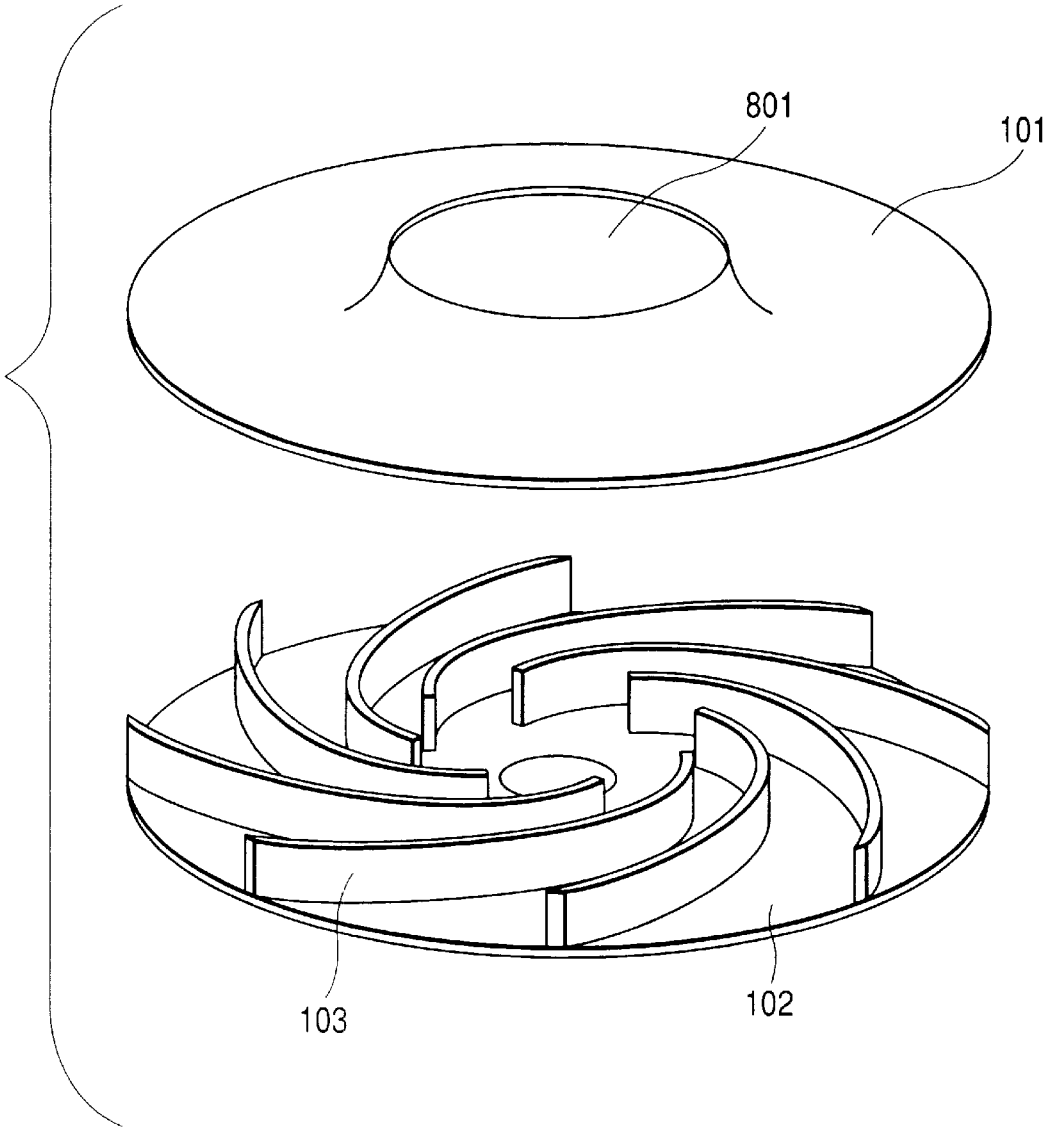
FIG. 5 is an exploded perspective view of an impeller according to the present invention.

In the foregoing first to fourth embodiments, the front plate 101 and the blades 103 are formed in a monolithic structure. The blades 103 may be formed integrally with the back plate 102 as shown in FIG. 5, and the front plate may be connected to the blades 103 by any one of the connecting methods explained in connection with the first embodiment to the fourth embodiment.

In the first embodiment to the fourth embodiment of the present invention, the impellers are lightweight, the air resistance acting on the surfaces of the plates is reduced, and the impeller of the motor-driven blower can be rotated at a rotating speed in the range of 45,000 to 50,000 rpm at a power consumption of 1000 W to operate the vacuum cleaner at a suction power of 550 W or above.

Figure 10:
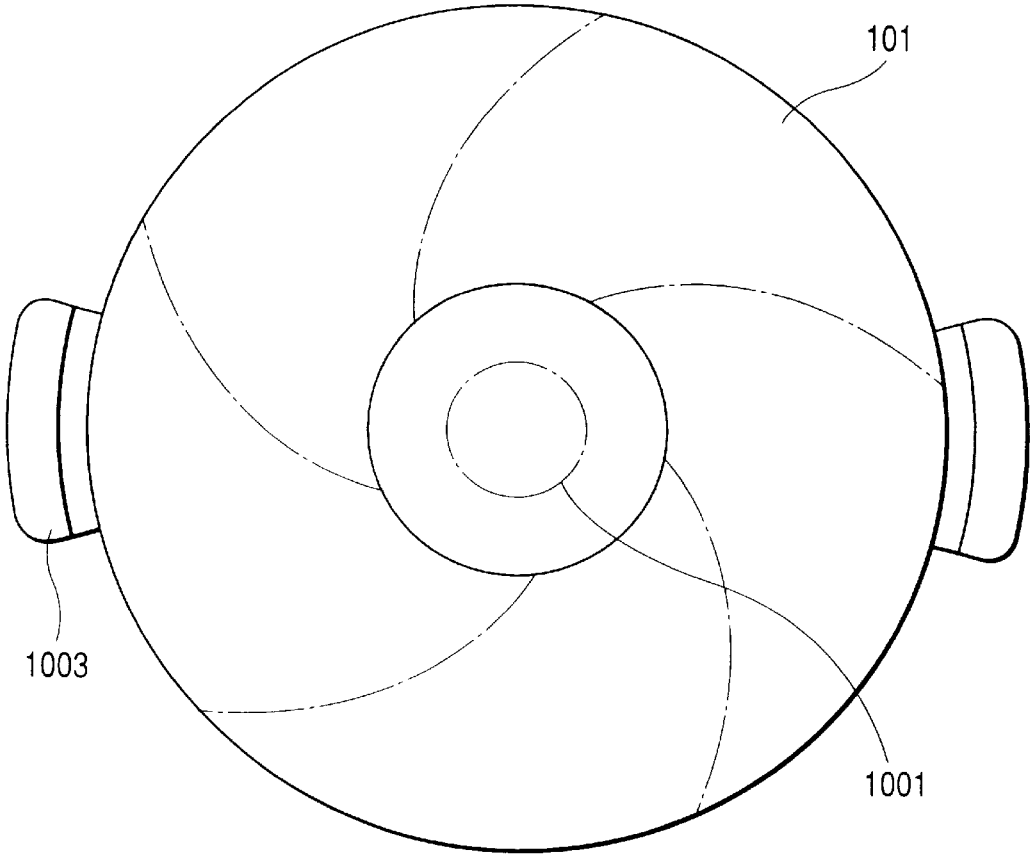
FIG. 10 is a plan view of an impeller according to the present invention.

Now referring to FIGS. 10 and 11, an injection molding in accordance with a preferred embodiment will be described.

In the preferred embodiment, both the inner diameter and the outer diameter of a front plate 101 are coaxially machined by means of a press punching operation or a machine cutting operation, so as to correct oscillation or bending or the like generated at the inner and outer diameter sections of the front plate 101 due to molding strain and to improve the accuracy of the coaxial relation therebetween. With such an arrangement as described above, the amount of unbalance of the impeller 712 generated by the molding operation is reduced and the accuracy of the balance is improved.

In particular, in the case where the motor-driven blower 701 used in an electric cleaner is rotated at a high speed, the above-described method of manufacture may not only provide an effect of reducing vibratory noise, but will also improve the accuracy in size at both inner and outer circumferences of the impeller 712, stabilize the combined size with respect to the fan casing 715 or the fixed stationary guide blades 714, as well as reduce any disturbance in aerodynamic performance.

In the preferred embodiment, a thin-film like gate 1002 is first formed beneath a molten metal supply funnel 1001 and across a suction opening 801 so as to cause molten metal to flow uniformly toward the circumference of the front plate 101.

In addition, the outer circumference of the plate 101 is provided with two molten metal reservoirs 1003 for preventing a lack of filling of molten metal. Although these reservoirs are required for stabilizing the quality when the product is injection molded, they are not required after the product has been formed, so that they should be removed after the molding operation.

Figure 11:
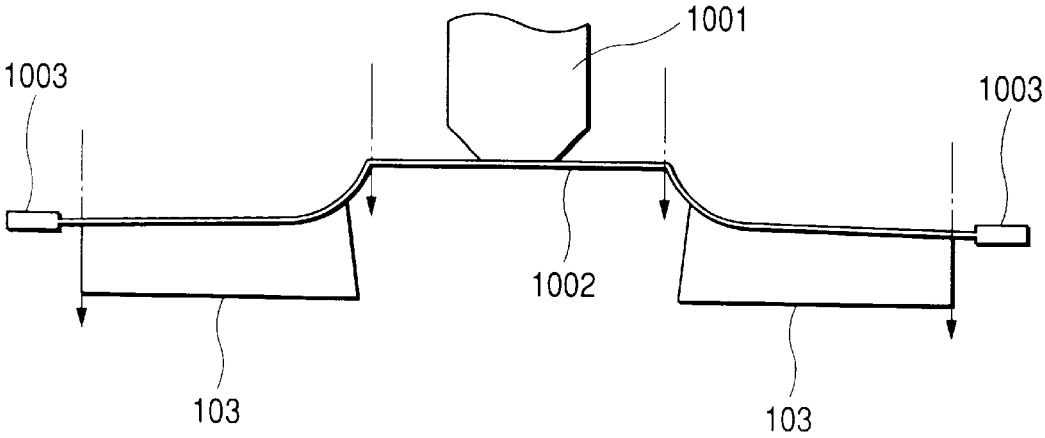
FIG. 11 is a longitudinal sectional view of an impeller according to the present invention.

In FIG. 11, each of the inner and outer circumferences indicated by arrows is removed. In this preferred embodiment, the gate 1002 beneath the molten metal opening 1001 and the molten metal reservoirs 1003 for preventing lack of filling, which are arranged at the inner and outer circumferences of the front plate 101, can be removed concurrently when the aforesaid inner so that outer diameters are post-machined, and the number of working steps is not increased.

Figure 12:
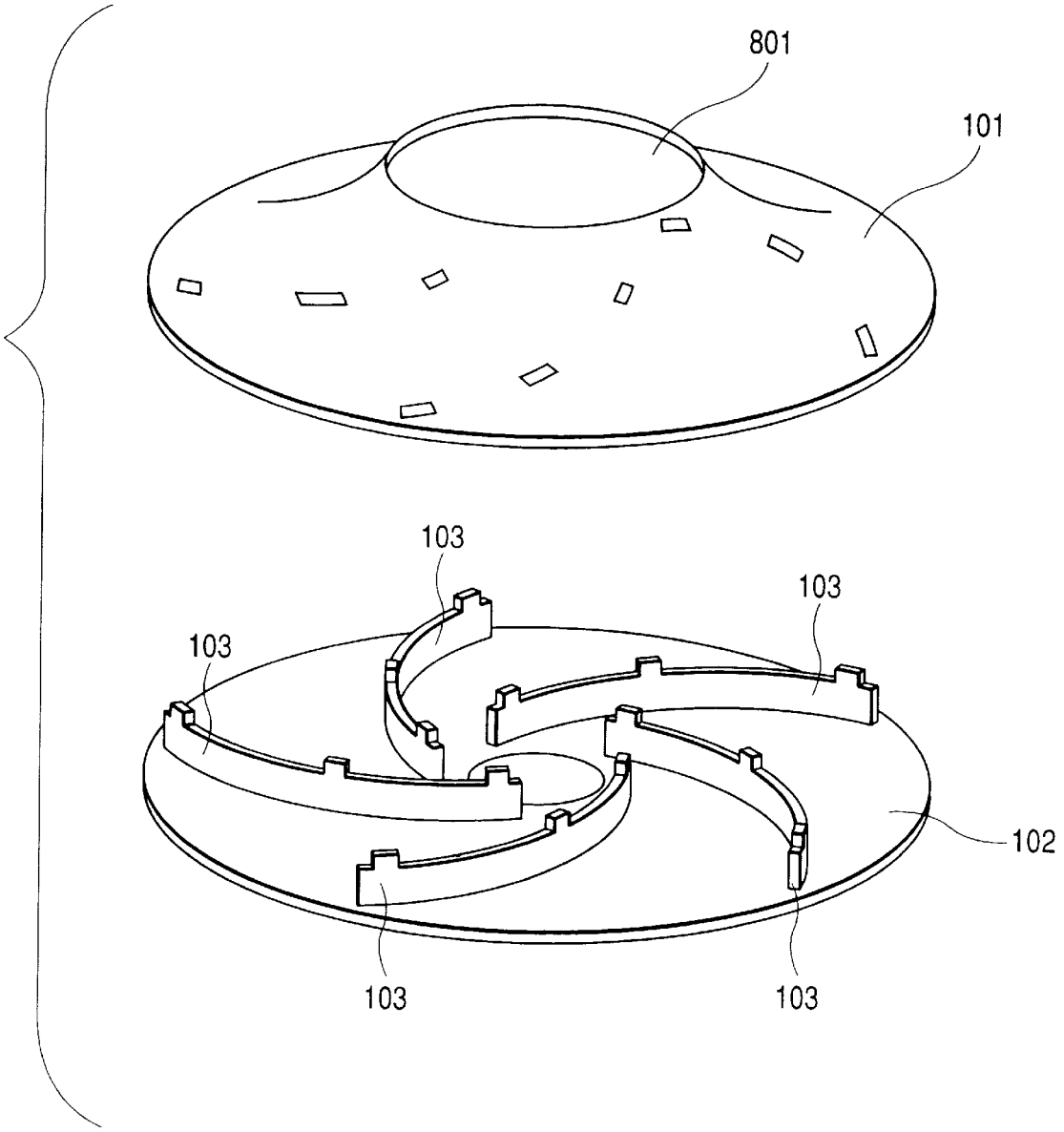
FIG. 12 is an exploded perspective view of an impeller according to the present invention.
Figure 13:
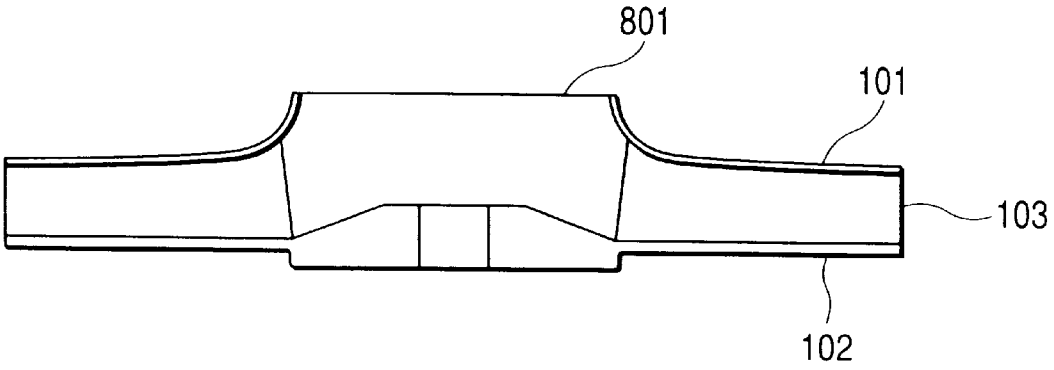
FIG. 13 is a longitudinal sectional view of an impeller according to the present invention.
Figure 14:
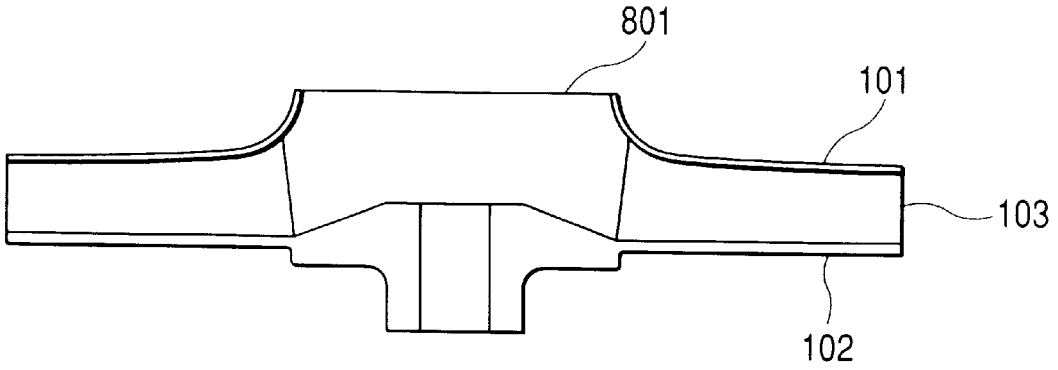
FIG. 14 is a longitudinal sectional view of an impeller according to the present invention.

As another preferred embodiment, in FIG. 12, which is a perspective view for indicating a state in which the rear plate 102 and the blades 103 are integrally molded, not only can a balancing of the accuracy or aerodynamic performance be improved, as described above, but also the parts can be formed into a structure as shown in FIGS. 13 and 14. That is, in FIG. 13, the inner circumferential part of the rear plate 102 having the weakest rigidity is made thick to enable its rigidity to be increased. In particular, such an arrangement is effective for a high-speed rotating machine.

In FIG. 13, the section of the impeller 712, which is located adjacent to an air flow passage at the suction port 801, is raised up to improve the flow at the inlet port, so that the aerodynamic performance is improved.

Further, in FIG. 14, the raised section is extended in an opposite to that of the rotating shaft 705 so as to form a fixing part for the rotating shaft 705, resulting in elimination of any need to provide another separate hub for fixing the member, as in the prior art.

Figure 15:
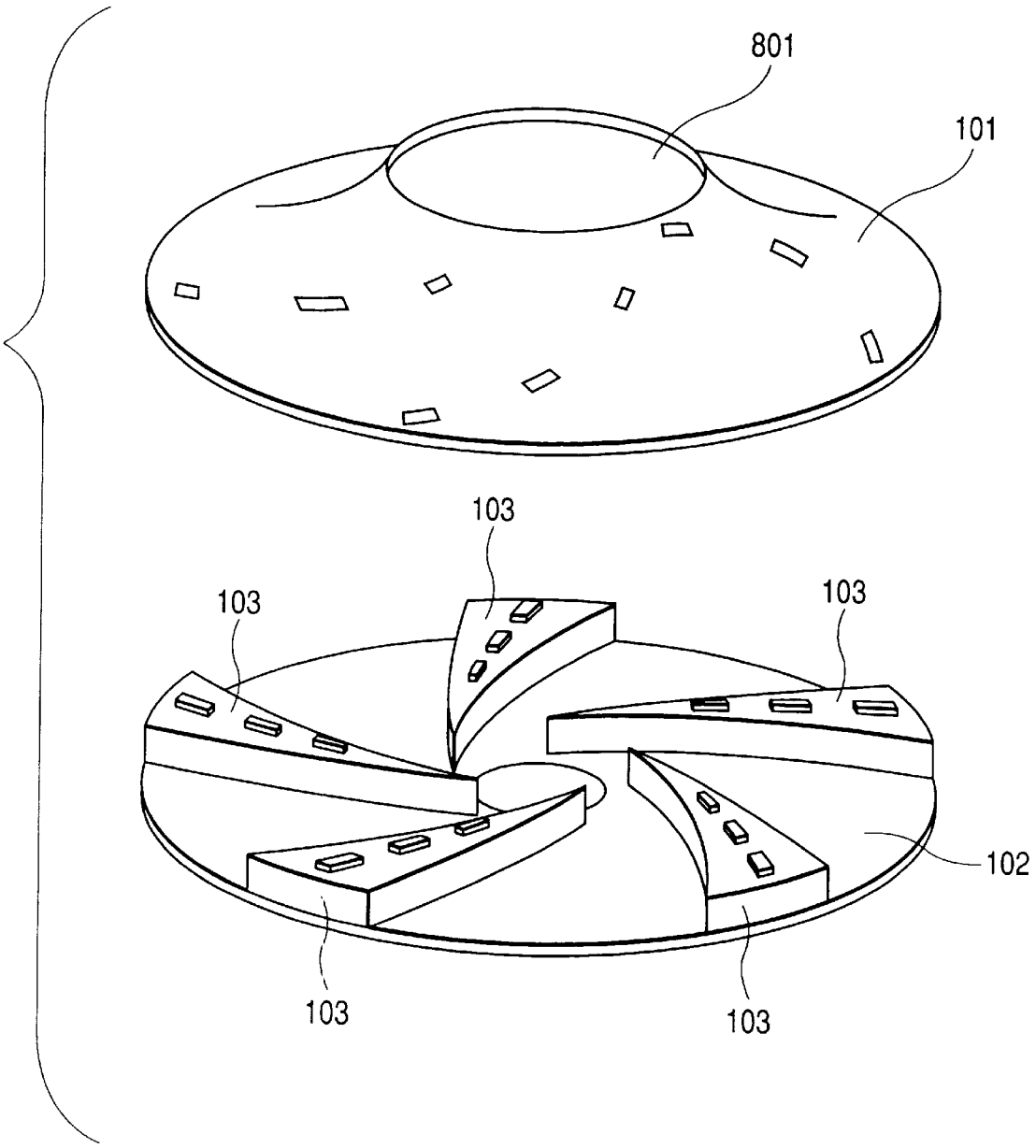
FIG. 15 is an exploded perspective view of an impeller according to the present invention.
Figure 16:
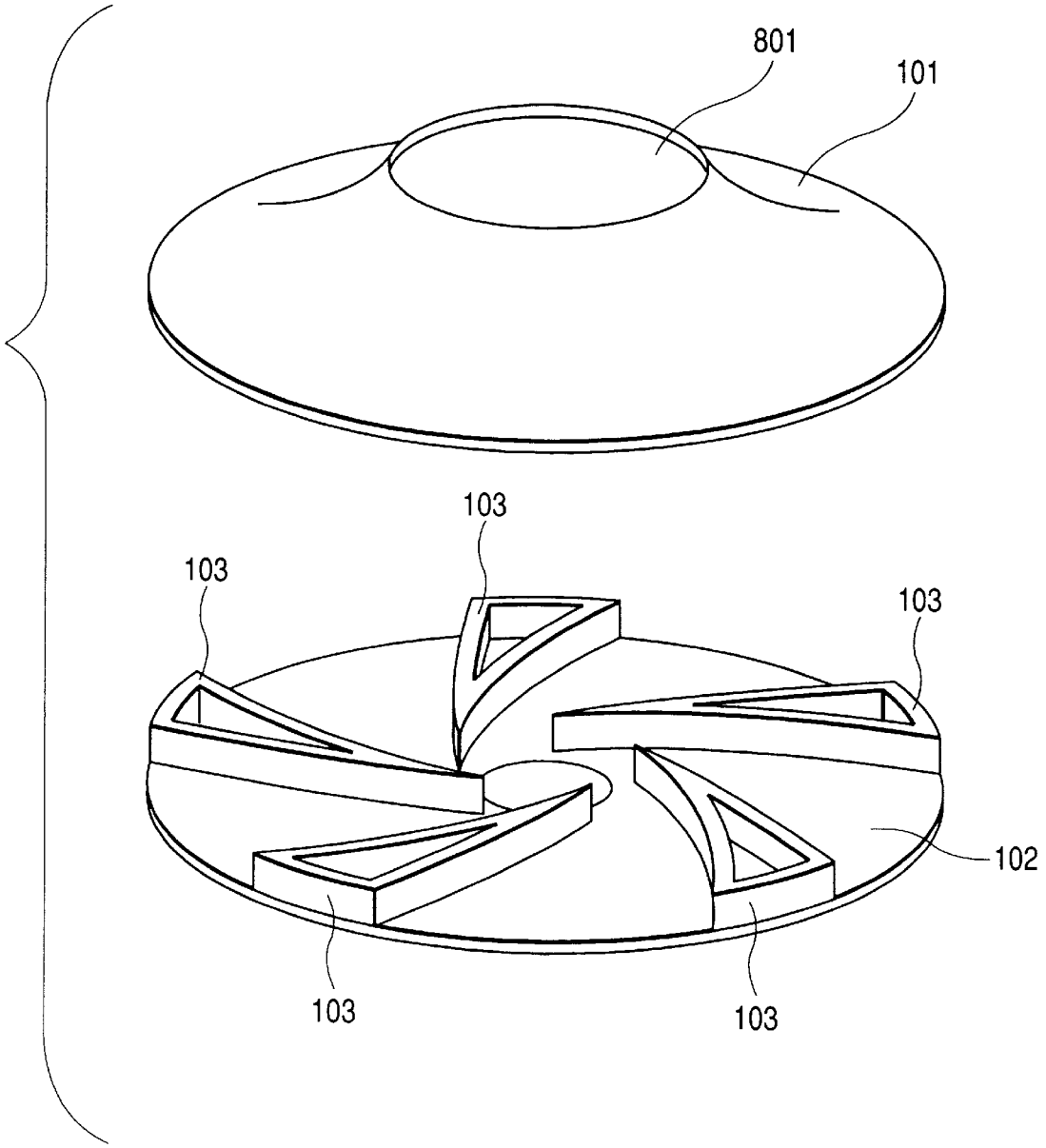
FIG. 16 is an exploded perspective view of an impeller according to the present invention.

In FIGS. 15 and 16, the thickness of the blade 103 is varied to form a so-called vane shape. FIG. 15 shows an example in which fixing claws for the front plate 101 are provided and FIG. 16, shows an example in which a center part of the blade 103 is removed to produce the mean thickness and improve a forming characteristic.

Both examples become possible due to the fact that the blade 103 and a mating plate are integrally formed, wherein the degree of freedom in design is increased beyond the case in which the blade and the plate were formed by a thin plate, as found in the aforesaid prior art, and the aerodynamic performance can be improved through an improved adaptation for flow within the impeller 712.

In the preferred embodiment described above, the front plate 101 and the blade 103 integrally formed together are formed of a magnesium alloy. This magnesium alloy is ASTM AZ91D of U.S.A. This AZ91D alloy is an alloy including 8.3 to 9.7 wt % of aluminum, 0.35 to 1.0 wt % of zinc and 0.15 to 0.50 wt % of manganese, wherein its forming characteristic is superior, and this is also a high purity product in which the amount of copper, nickel and iron is restricted.

In the preferred embodiment, although the integrated part forming the front plate 101 and the blade 103 is made of AZ91D magnesium alloy, it is also preferable for it to be made of AM60B magnesium of ASTM Standards of U.S.A, including 5.5 to 6.5 wt % of aluminum, 0.22 wt % of zinc and 0.24 to 0.6 wt % of manganese.

The specific weight of the magnesium alloy ($g/cm^3$) is approximately 1.8 and so a light weight formation which is about ⅔ that of the specific weight of 2.7 of aluminum alloy can be attained.

In addition, in the preferred embodiment, although the rear plate 102 is made of A5052 aluminum alloy of JIS Standards, it is also possible to select any one of Al—Mn alloy (system 3000), Al—Si alloy (system 4000), Al—Cu—Mg alloy (system 2000), Al—Mg—Si alloy (system 6000) and Al—Zn—Mg alloy (system 7000).

As described above, in accordance with the present invention, employing of magnesium alloy for the impeller 712 enables the weight of the impeller 712 to be reduced and further enables the load applied to the rotating shaft to be reduced.

In addition, in accordance with the present invention, the impeller is integrally formed to eliminate the need for fastening protrusions, so that it is possible to reduce the air resistance and noise or the like caused by the fastening protrusions as the impeller rotates at high speed.

Further, in accordance with the present invention, the inner and outer diameters of the front plate 101 are coaxially machined, after a forming operation, by performing a press punching or a machine cutting operation or the like so as to correct any twisting and bending generated at the inner and outer diameter section due to formation of strain, so that the coaxial accuracy is improved. With such an arrangement described as above, the amount of unbalance of the impeller 712 generated during the forming operation is reduced and the accuracy of balance is improved. In the case where the motor-driven blower 1 used in an electric cleaner or the like, and, in particular, is rotated at a high speed, although the invention may provide a high effect in reducing vibratory noise, it also may provide a greater accuracy in the size of the inner and outer circumferences of the impeller 712, not to mention stabilizing the combined size of the fan casing 715 and the stationary guide blades 714 and eliminate a disturbance in aerodynamic performance. Additionally, gate required in case of a molding operation and the molten metal reservoirs for preventing a lack of filling, which are arranged at the inner or outer circumferences of the front plate 101 can be removed concurrent with the post-machining operation for the aforesaid inner and outer diameters, so that the number of working steps need not be increased.

It will be further understood by those skilled in the art that the foregoing description related to a preferred embodiment of the disclosed device and that various changes and modifications may be made therein without departing from the spirit and scope of the present invention.

What is claimed is:

1. A motor-driven blower comprising: an electric motor covered with a housing; an impeller fixedly mounted on a rotating shaft included in the electric motor; stationary guide blades disposed on the downstream side of the impeller; and a fan casing covering the impeller and the stationary guide blades;

wherein the impeller comprises a front plate having a suction opening, a back plate disposed opposite to the front plate, and a plurality of blades disposed between the front plate and the back plate: and wherein the front plate and the blades are formed of a Mg alloy in a monolithic structure, and the back plate is formed of an Al alloy.

2. A impeller comprising: a front plate; a back plate disposed opposite to the front plate; and a plurality of blades disposed between the front and the back plate;

wherein either one side of the front plate or the back plate is formed integrally with the blades, a brazing metal layer is formed on a surface of the other plate not formed integrally with the blades, and the other plate is brazed to the blades by the brazing metal layer, wherein a surface treatment process of forming the brazing metal layer is one of a plating process, an evaporation process, an ion plating process, a spraying process and a combination of those processes.

3. An impeller comprising: a front plate; a back plate disposed opposite to the front plate; and a plurality of blades disposed between the front plate and the back plate;

wherein at least one of the front plate and the back plate is formed integrally with the blades, the blades are provided with a plurality of projections, the other plate not formed integrally with the blades has a surface coated with a bracing metal layer and provided with holes at positions respectively corresponding to the projections of the blades;

the plurality of projections of the blades project into the holes of the plate, respectively, the blades are brazed to the plate by the brazing metal layer, and the projections are heated and welded to the plate.

4. The impeller according to claim 3, wherein the projections are heated and welded to the plate by one of a laser welding process, an electron beam welding process, an electric resistance welding process and a combination of those processes.

5. A motor-driven blower comprising: an electric motor in a housing; an impeller fixedly mounted on a rotating shaft of said electric motor; stationary guide blades disposed on the downstream side of said impeller; and a fan casing for covering said impeller and said stationary guide blades;

wherein said impeller comprises a front plate having a suction opening, a back plate disposed opposite to said front plate and having a fixing part for fixing the impeller to said rotating shaft, and a plurality of blades disposed between said front plate and said back plate; a molten metal opening disposed in the inner circumferential surface of said front plate or said back plate, and a molten metal reservoir disposed in the outer circumferential surface of said front plate or said back plate; and at least one of said front plate and said back plate is formed integrally with said blades, and after the integral formation, an inner circumferential surface and an outer circumferential surface of the integral formed plate are machined.

6. The impeller according to claim 5, wherein at least one of said front plate and said back plate is formed integrally with said blades by one of an injection molding process ro a die casting process; and after the integral formation, at least one of an inner circumferential surface and an outer circumferential surface of said plate is additionally machined by either a press machining process and a mechanical machining process.

7. A motor-driven blower comprising: an electric motor in a housing; an impeller fixedly mounted on a rotating shaft included in the electric motor; stationary guide blades disposed on the downstream side of the impeller; and a fan casing covering the impeller and the stationary guide blades;

wherein the impeller comprises a front plate having a suction opening, a back plate disposed opposite to the front plate, and a plurality of blades disposed between the front plate and the back plate; and wherein at least one of the front plate and the back plate is formed monolithically with the blades and the other plate not formed monolithically with the blades is joined to the blades.

* * * * *